United States Patent [19]

Franz et al.

[11] Patent Number: 4,622,238

[45] Date of Patent: Nov. 11, 1986

[54] PROCESS FOR THE PRODUCTION OF BULKY, FIBROUS TEXTILE SHEET MATERIALS

[75] Inventors: Günter Franz, Friedberg/Derching; Bruno Reisch, Augsburg; Michel Pässler, Neusäss, all of Fed. Rep. of Germany

[73] Assignee: Firma Carl Freudenberg, Weinheim, Fed. Rep. of Germany

[21] Appl. No.: 798,134

[22] Filed: Nov. 13, 1985

Related U.S. Application Data

[63] Continuation of Ser. No. 583,123, Feb. 24, 1984, abandoned.

[30] Foreign Application Priority Data

Feb. 26, 1983 [DE] Fed. Rep. of Germany ..... 3306913

[51] Int. Cl.[4] ..... B05D 3/02; B05D 5/00

[52] U.S. Cl. ..... 427/45.1; 427/244; 427/373; 427/389.9; 521/68

[58] Field of Search ..... 427/45.1, 244, 373, 427/389.9; 521/65, 68

[56] References Cited

U.S. PATENT DOCUMENTS

| | | | |
|---|---|---|---|
| 3,216,849 | 11/1965 | Jacobs | 427/45.1 |
| 3,579,372 | 5/1971 | Healy | 427/45.1 |
| 3,583,882 | 6/1971 | Bartrag | 427/45.1 |
| 4,324,827 | 4/1982 | Obayashi et al. | 427/45.1 X |
| 4,401,708 | 8/1983 | Paul | 427/45.1 X |

FOREIGN PATENT DOCUMENTS

| | | | |
|---|---|---|---|
| 947546 | 8/1956 | Fed. Rep. of Germany | 427/45.1 |
| 0136238 | 6/1979 | Fed. Rep. of Germany | 427/373 |

*Primary Examiner*—Michael R. Lusignan
*Attorney, Agent, or Firm*—Felfe & Lynch

[57] ABSTRACT

A process for the production of bulky, fiber-containing textile sheet material fills a material of loose fibers with a binding agent of an aqueous polymer dispersion containing a foaming adjuvant and puffs it up to a multiple of its original volume by the action of radiofrequency radiation in the range from 30 kHz to 30 GHz. The volume increase is then made permanent by drying. Even cellulosic fibers which formerly matted down when wet can be treated in the stated manner. The puffed textile sheet material is usable as padding for articles of clothing, for sound and heat insulation soft and resilient packing materials, clothing, protective padding and the like, but especially for products which are to absorb liquids to a relatively great extent.

17 Claims, No Drawings

PROCESS FOR THE PRODUCTION OF BULKY, FIBROUS TEXTILE SHEET MATERIALS

This is a continuation of application Ser. No. 583,123, filed Feb. 24, 1984 and abandoned herewith.

The invention relates to a process for producing bulky, fiber-containing textile sheet material.

Bulky, fibrous textile sheet materials can be used in many applications. They are outstandingly suitable for the padding of articles of clothing, for the insulation and damming of sound and heat or cold, for the absorption or take-up of liquids, especially water, for especially-soft and resilient packing material, and many other applications.

The bulky, fibrous textile sheet materials are produced from fibers, especially in the form of batting, nonwovens or fleece-like materials, and as a rule, they are loosely held together with binding agents, i.e., with aqueous dispersions of suitable polymers, and/or with binding fibers. The binding agent dispersions, which usually contain crosslinking agents, catalysts, thermosensitizing agents, dyes, wetting agents and other adjuvants and are referred to commonly as "binding agent liquor," can be put into the fiber material by spraying, by sprinkling, printing or impregnation.

In the case of spraying, sprinkling and printing, the application is made usually to both sides of the sheet material to obtain a product that is the same on both sides.

Impregnation of the sheet material is therefore more economical. The material or collection of fibers is dipped into the binding agent liquor. The excess is then removed by suction or by pressing. In this manner a uniform penetration of the binding agent liquor into the sheet material is achieved.

Also commonly practiced is the impregnation of textile sheet materials with foamed binding agent liquors. In this case, the drying costs are reduced on account of the low water content. The amount of binding agent applied can thus also be reduced and, thus, somewhat softer and bulkier products are obtained than with unfoamed binding agent liquors. These soft and bulky products are used in the applications mentioned in the beginning. The foam structure of the foamed binding agent liquor, is not preserved during the impregnating process, however because the foam bubbles of the foamed binding agent liquor are largely or entirely destroyed and liquefied during the aspiration or pressing. Any remaining foam bubbles are burst either by the absorbing action of the fibers, or at the latest during the drying. A decided disadvantage of the impregnation method is therefore that the material is made denser and thinner in the process, for example in the wet state under the pressure of the rolls used for the pressing, and thus loses the desired bulk and softness it could have had. Even if the excess binding agent liquor is aspirated, a loss of bulk, depending on the kind of fiber occurs, but as a rule it is less than in the case of pressing.

With regard to the thickness, therefore, there is no great advantage in impregnating the sheet material with foamed binding agent liquors because, in the wet state, it easily becomes densified. To a very particularly striking degree, fiber fleeces and fleece-like materials made from cellulosic fibers such as cotton and rayon, even when they are prebound mechanically by needling, are made thinner and denser by the impregnating process, even if only water is used for the impregnation. This phenomenon, also known as "slumping" is to be attributed to the pronounced ability of cellulosic fibers to absorb and retain large amounts of water. As a result, the thickness of the material is undesirably reduced, even under light mechanical pressures, such as those produced by the aspiration of the excess binding agent liquor. Similar comments apply to the application of the binding agent liquor by spraying or sprinkling, and even more so when it is applied by printing.

Ordinarily, the wet sheet material containing binding agent is dried, and heated to temperatures above 100° C. for the crosslinking or vulcanization. The heating is performed either in convection dryers (screen belt or flat belt dryers) or on contact dryers (cylinder dryers). Also, radiant dryers having infrared radiators of wavelengths of about 0.7 to 200 micrometers are used for the preliminary drying, or for the coagulation of thermosensitive binding agent liquors in the fiber web prior to the actual drying. As a result, a preliminary bonding is achieved by coagulation of the binding agent at 40° to 80° C., the binding agent being locally fixed and migration during the after-drying being prevented. In spite of these precautionary measures, however, the thickness of the impregnated, aspirated or pressed, sprayed, sprinkled or printed web is reduced or, in the most favorable case, only maintained.

It has therefore also been proposed for the achievement of a greater thickness or greater bulk that the dried material be fulled in a subsequent, special process step. The increase of volume, however, is unsatisfactory, because the fibers are joined together by the binding agents fixing their position and have become immovable. Now, it is the object of the invention to develop an economical process for the production of especially bulky, thick, fibrous textile sheet materials which can be used in the applications mentioned in the beginning, and which, depending on their application, will not tend to "slump," even in use, especially when treated with water, i.e., to form a lastingly-fixed, bulky structure. Dry- or wet-laid fleeces, loosely bound nonwovens, i.e., fleeces whose fibers have sufficient mobility, and, in some cases, correspondingly loose weaves or knits, are to be processed as the fibrous, textile sheet materials. The impregnation of such fibrous, textile materials is to be performed with aqueous binding agents or binding agent liquors which, upon drying, crosslink or vulcanize, as the case may be.

The object of the invention is achieved by the process of filling batting, fleece or like material of loose fibers with a binding agent of an aqueous dispersion of at least one polymer which is cross-linkable or vulcanizable and a foaming adjuvant and subjecting the filled material to radiofrequency radiation in the range of from 30 kHz to 30 GHz for puffing up the material to a multiple of its original volume. The puffed up material is then dried for so bonding it and crosslinking or vulcanizing the polymer for so stabilizing it.

It is surprising that the textile sheet materials exposed to the radiofrequency field of the stated frequency are not only permanently consolidated, but also that they are puffed up to a previously unknown degree. The wet textile materials which "slump" in conventional processes or at best retain their bulk, puff up to a multiple of their original bulk. The puffed structure is stable and is retained even in use, depending on the application, i.e., even when treated with water.

In the "radiofrequency" range between 30 kHz to 30 GHz, frequencies of 10 MHz to 3 GHz are preferred.

The puffing up of the wet textile web with the formation of a permanently fixed, bulky structure in the radiofrequency field is also surprising because, according to information in the literature ("Vliesstoffe", J. Luenenschloss and W. Albrecht, Stuttgart 1982, pages 219–221), no comparable effect occurs in heating a web to vaporization of water and the crosslinking of the binding agent liquor by treating the web between the electrodes of a high-frequency condenser. In this proposal, also, spark perforations impairing the quality and the product can easily occur, and can be so great that burnt holes are formed in the web of goods. Also, in operation under these conditions at high field strengths, excessively rapid heating relative to the (low) permeability to water vapor forms steam bubbles which are found to be undesirable and which, furthermore, collapse after cooling. For this reason, high-frequency dryers have achieved no practical importance in the drying and consolidation of fleece. It is known that they lead, as a rule, to impaired products. Use has never been made of radiofrequency dryers for the achievement of special product qualities, especially for the achievement of products having stable, improved bulk. They are commonly used at most for the hot-welding of so-called high-frequency-weldable batting and nonwoven materials.

Neither has use been made of microwaves in the gigahertz range in the manner of the invention. All that is known is the drying of products, but no increasing of bulk is observed.

The proposed method can be applied to all fibrous textile sheet materials whose fibers are mobile to a sufficient degree. They are especially loose, fibrous fleeces or nonwoven materials. Surprisingly, cellulosic fibers are suitable which "slump" when processed by methods of the prior art. The fibers can be pre-bonded mechanically and/or adhesively or cohesively. The wet textile sheet material containing foaming adjuvants is exposed to a radiofrequency field of the wavelength range from 30 kHz to 30 GHz, while a foaming up of the liquid containing the foaming adjuvant takes place simultaneously with the spontaneously occurring vaporization of water. The wet, fibrous substrate is considerably puffed up by the foam bubbles that form and thus receives a greater bulk in comparison to its bulk before the treatment. It is simultaneously dried in this state and, if desired, condensed or vulcanized. The thickness increase is considerable. It reaches values of up to more than 300% with respect to conventional impregnation without radiofrequency treatment.

The wavelength range of 10 MHz to 3 GHz has proven especially effective. The fiber fleeces or batts of loosely deposited fibers are best lightly preconsolidated, but the mobility of the fibers must be retained to the desired degree. Also mechanically, e.g., by needling, adhesively by liquid or solid binding agents, or cohesively by softening or welding the fibers together. Consolidated textile sheet materials must be made such that the fibers remain movable on one another or in layers on one another during the foaming that occurs under the radiofrequency treatment. For this reason, those materials are especially suitable whose separating force, determined in accordance with DIN 53357, does not exceed 30N per 50 mm of strip width. The lower the separating force, the higher the thickness increase is, and vice versa. The separating force is thus suitable for controlling the increase of the thickness of the material under otherwise equal process conditions. The separating force itself can be varied in a conventional manner, e.g., in the case of needled nonwovens, by the needle density number of stitches per cm) or the needle plunge depth, or, in the case of other pre-bonded nonwovens, by the nature, amount and distribution of the binding agent or binding fibers which are used for the preliminary consolidation.

Although textile sheet materials of any composition, on the conditions set forth above, can be used, cellulosic fibers are especially desired, because on the one hand they become especially thin by the known processes for the application of binding agents, and on the other hand they are suitable for many applications on account of their good absorbency. The binding agent liquor can be added to the textile, fibrous materials by conventional methods, especially by impregnation. The process results in puffed-up products even if only water and foaming adjuvant are used. The squeeze-out effect is between 80 and 500% with respect to the weight.

Although water with foaming adjuvants shows a definite effect, it is preferred to use aqueous binding agent liquors containing foaming adjuvants. The increase in thickness achieved by the radiofrequency exposure is then stabilized and fixed, after drying and after crosslinking or vulcanizing the binding agent, by making the fibers stick to one another. After the high-frequency exposure, it is desirable to perform a drying or crosslinking and/or vulcanization using flat belt or sieve belt dryers. Such dryers exert only a slight pressure on the puffed and still-moist material, so that the desired bulky structure is preserved.

Basically all conventional binding agents can be used which are known for the consolidation of fleeces and batts, e.g., polymers or copolymers on the basis of latex, acrylate, methacrylate, polyurethane, butadiene-acrylonitrile, butadienestyrene, a copolymeric precondensate of any of the former, or formaldehyde resin with phenol, melamine and urea resin, or mixtures thereof.

It is desirable that the binding agent liquors contain conventional additives such as crosslinking agents, catalysts, thermosensitizing agents, dyes, wetting agents, and the like. It is desirable to use as foaming adjuvants emulsifiers or tensides admixed with the binding agent dispersions. Binding agent dispersions which inherently contain no foaming agents and possibly might result in too little bulking-up in the practice of the process are treated before use with a separate conventional foaming agent.

It is desirable to use as foaming adjuvants alkali salts of higher fatty acids, sulfonated oils, alkyl and aralkyl sulfonates, alkyl sulfates, fatty acid condensation products, hydroxyalkyl sulfoxides, amino oxides, ampholytes and other products known in themselves to be emulsifying and crosslinking agents and detergents, to the extent that they have good foaming ability. This can be determined, if necessary, by suitable simple preliminary testing. The foaming adjuvants, upon intensive contact with air, develop bubbles which are enveloped in a tenside layer. In the proposed process, the puffing-up is produced less by air bubbles than by steam bubbles, the steam being formed from the binding agent liquor by the high-frequency treatment.

The more intense the foaming, the more stable the tenside coating on the bubbles, the higher the moisture content, the higher the field strength of the electrical alternating current field, the higher the absorbed power, the quicker the dielectric heating of the substrate, and the higher the vapor pressure, the greater becomes the propellent force with which the wet fiber structure, or the fiber structure containing binding agent, will be driven apart. In addition to the separating force of the material, numerous other influencing and controlling magnitudes therefore exist for the outcome of the increase in volume or thickness. If the above relationships are known, the parameters in each case are easy to determine by simple preliminary experiments, and the high absorption of power after entry into the high-frequency field will result in a spontaneous vaporization of water and simultaneous formation of foam bubbles. The maximum foam depth can be achieved within approximately 5 seconds.

The wet, fibrous web of material can be exposed to high-frequency beams in different ways. In the simplest case, the wet web is passed between the electrode plates of the high-frequency radiator. Depending on the composition, especially on the binding agent liquor and its electrolyte content, however, arc perforations can take place, especially when operating in the megahertz range. An especially preferred embodiment of the process, which avoids this danger, consists in running the web of goods, not between the electrode plates, but parallel along the electrode rods mounted on one side. By appropriate shielding it is easy to prevent water vapor from entering into the electrode gap. The electrode and counter-electrode, therefore, are located on the same side of the web. In this manner, no spark perforations can pass perpendicularly through the material. If any spark perforations at all take place, this will be parallel to the web of goods. By appropriate spacing of the electrodes and appropriate electrode voltages, however, it is quite possible to prevent spark perforations entirely.

In special cases—for example, when the fibers of the textile sheet material and/or the binding agent liquors have an excessively high electrical conductivity for special reasons of the product make-up, e.g., due to high ion or electrolyte content, it is possible by operating in the microwave range, i.e., in the gigahertz range, to avoid the danger of spark perforation. When operating in the gigahertz range the danger of spark perforation is so slight that, as a rule, the wet web of goods can also be passed between the electrodes. On account of the higher frequency, lower electrode voltages can be applied.

If the above-described circumstances are understood, the most suitable frequency can easily be determined in the individual case. The internationally released and commonly used frequencies for industrial applications at this time, of 13.56, 27.12 and 450 MHz, and, in the giga region, 2.45 GHz, can be used. Basically, the range defined in the claims is suitable. In many cases, the range around 10 GHz is preferred on account of the high ability of water to absorb it. The choice of the high-frequency range can also be influenced by the width of the goods. Thus, it is advantageous to operate in the lower megahertz range, at the greater wavelength present there, if a great width of goods is desired. The frequency of 27.12 MHz corresponds, for example, to a wavelength of about 11 m. In the half-wave range of 5.5 m, therefore, an effective useful width of the web of goods of about 2 m can be achieved. The wavelength of 13.56 MHz amounts to about 22 m, so that the useful width is doubled. In the case of microwaves of 2,450 MHz, the wavelength, on the other hand, is only 12.3 cm. A useful unit of only a few centimeters is then obtained per unit, so that in this case an apparatus having numerous units disposed side by side would have to be used. This is possible technically at this time, however, only up to about 50 cm of working width, so that only relatively narrow webs of goods can be exposed. The following examples show how the process claimed is performed. On the basis of the above-indicated circumstances, additional embodiments can be made up in many variations, in accordance with the particular requirements and operating conditions.

EXAMPLE 1

A fiber fleece of cellulose, weighing 235 g/sq m, which has been needled at 25 stiches per sq cm, and has a separating force based on DIN 53,356 of 8N/50 mm, is immersed in a 10% aralkyl sulfonate liquor and pressed out to a wet absorption of 130%. Upon passing through a radiofrequency stray field of 27.12 MHz and a power absorption of 2.9 kW, the material of an original thickness of 3.1 mm (1.6 mm after squeezing) is swelled up within 3 seconds by foaming to a final thickness of 5 mm. The material is dried in a conventional belt dryer at 110° C. The resultant material is stretchy and of very soft hand. It is suitable, for example, as a packing material.

EXAMPLE 2

A fiber fleece weighing 250 g/sq m, of 50% cotton, 42% rayon and 8% PES, needled at 20 stitches per cm sq, and having a separating force based on DIN 53,357 of 10N/50 mm, is imbibed with a binding agent liquor of acid-crosslinking butadiene-styrene-latex and catalyst (total solid content 25%) and squeezed down to 120% wet absorption. The material thus imbibed is moved over the stray field electrode of a radiofrequency generator of a frequency of 27.12 MHz, whereupon the material is puffed up within 2 seconds by foaming from an initial 3.1 mm to 6.2 mm. It leaves the radiofrequency field while still steaming and is then dried and condensed in the belt dryer at 140° C. The resultant material has large voids in the interior, is elastic, and absorbs approximately 600% of its own weight of water.

EXAMPLE 3

A fiber fleece containing 85% cotton staple and 15% PP as binding fiber, and also needled at 25 stitches per sq cm, has, after the known method of production, a separating force based on DIN 53,357 of 13N/50 mm. This material is impregnated with a binding agent liquor of acrylate dispersion, melamine resin, catalyst, and 1.7% of foaming adjuvant from the group of the ampholytes, and it is squeezed out to 90% wet absorption. Upon passing through the radiofrequency stray field, the material is puffed up within 5 seconds from initially 2.9 mm to 3.5 mm. After drying and condensation at 135° C., a soft, sandwich-like material is obtained.

EXAMPLE 4

A fleece weighing 250 g/sq m and needled at 25 stitches per sq cm, and composed of 50% cotton, 42% and 8% polyester fibers, is prepared by conventional methods, but the needle board used in the needling machine has in rows in the production direction thicker and stronger-acting needles than the rest, so that a longitudinal structure is formed. An electrolyte-resistant butadiene nitrile latex is treated with conventional additives (sulfur, zinc oxide, vulcanizing agents) and foaming agents based on alkylsulfonate, and rendered thermosensitive to a coagulation point of 55° C. by the addition of sodium chloride plus an organopolysiloxane of the type known as Coagulat WS® (Bayer AG) and an ethoxylation product of the type known as Emulvit W® (Bayer AG). The needled fleece is imbibed with the foamed binding agent liquor and squeezed out to a wet absorption of 100%. Then it is treated in the microwave field with a power of 2.5 KW and a frequency of 2,450 MHz. The material was thus puffed up from an initial thickness of 3 mm to 4.7 mm, developing a wavy profile.

The bulky fleece-like material is dried and vulcanized at 150° C. on a conventional belt dryer, thereby stabilizing these profiles. Then soluble components are washed out of the latex on a conventional, continuous washing machine. After another drying, a soft material is obtained whose binding agent and voids are uniformly distributed over the cross section, and which is three-dimensionally structured on its surface.

EXAMPLE 5

A fiber fleece weighing 220 g/sq m and composed of 33% cotton, 44% rayon containing carboxyl groups, and 23% polyester fibers, is needled at 29 stitches per sq cm and impregnated between 2 rotating rollers with a foamed butadiene-acrylonitrile latex to which conventional additives (sulfur, zinc oxide, vulcanization accelerator, wetting agents) were added, and dried on cylinder dryers. Due to the partial migration of binding agent, a skin is formed at the surfaces. The material thus prebonded has a separating force based on DIN 53,357 of 21N/50 mm and has a thickness of 2 mm. It is imbibed with a binding agent liquor of acid-crosslinking butadiene-acrylonitrile latex containing stabilizing agent and catalyst, and squeezed out to a wet absorption of 150%. Upon passing through a microwave field of a frequency of 2,450 MHz and a power of 2.7 kW, the thickness of the goods increases to 3.1 mm. Drying and condensation take place in a conventional belt dryer at 140° C. The resultant material has an improved surface strength.

EXAMPLE 6

A fiber fleece weighing 150 g/sq m and composed of 80% polyamide and 20% polyester fibers is needled at 19 stitches per sq cm. The 8-mm-thick fleece, which has a separating strength of less than 1N/50 mm, is impregnated with a 50% binding agent liquor of phenol-formaldehyde resin, aluminum oxide of F 240 grit size, thickening agent and foaming adjuvant of the aralkyl sulfonate type, so that a weight increase of 900 g/sq m occurs, and then exposed to a radiofrequency field of 27.12 MHz and a power of 4.5 kW. A considerable increase of thickness takes place. The expanded material is dried and condensed at 170° C. in a conventional belt dryer. A very open-structure material 10 mm thick is obtained, which has a considerable scouring quality on the basis of its abrasive grit content.

EXAMPLE 7

106 g of butadiene-acrylonitrile-latex having a solid content of 47% and containing conventional additives (sulfur, zinc oxide, vulcanization accelerator, organopolysiloxanes, foaming adjuvants etc.) is rendered heat-sensitive with a coagulation point of 55°–60° C. and foamed up to twice its volume. 350 g of a 10 wt-% suspension of cellulose staple fibers of 5.6 dtex/8 mm, cellulose (weight ratio 75:25) and foaming adjuvant are added and the entire mass is foamed up to 1,100 ml. The foam latex-fiber mass thus obtained is applied to a supporting fabric in a thickness of about 3 mm and passed under a microwave radiator of a frequency of 2,450 MHz and a power of 1.8 kW. This produces a thickness increase to 4 to 5 mm with simultaneous coagulation of the mass. In the units next following the product is dried, vulcanized, washed, and again dried. After separation from the supporting fabric, a sponge-cloth-like material results having open and closely spaced pores which are uniformly distributed over the cross section.

We claim:

1. A process for the production of bulky, fiber-containing textile sheet material from a material of loose fibers comprising:

filling the material of loose fibers with a binding agent comprising an aqueous dispersion of at least one polymer which is one of crosslinkable and vulcanizable and a foaming adjuvant;

puffing up the filled material only by subjecting the filled material to sufficient radiofrequency radiation in the range of from 30 kHz to 30 GHz to a multiple of its original volume; and drying the puffed-up material for so bonding it and one of crosslinking and vulcanizing the polymer for so stabilizing it.

2. Process of claim 1, wherein the binding agent is thermosensitive.

3. Process of claim 1, wherein the radiofrequency radiation has a frequency of 2.0–3.0 GHz.

4. Process of claim 1, wherein the radiofrequency radiation has a frequency of 10 to 500 MHz.

5. Process of claim 1, wherein subjecting the filled material to the radiofrequency radiation comprises subjecting the filled material to stray-field radiofrequency radiation while moving the filled material as a web past electrodes radiating the radiofrequency radiation at a distance from and parallel to one side of the web.

6. Process of claim 1, wherein the polymer is an electrolyte-resistant latex and the binding agent further comprises at least one of a pore former and a water-soluble salt.

7. Process of claim 2, wherein the polymer of the thermosensitive binding agent is latex having a coagulation point between 30° and 80° C.

8. Process of claim 1, wherein the polymer is latex and the binding agent further comprises fibers with a fiber-to-latex ratio in the range of from 80:20 to 10:90 weight-percent, with respect to the dry weight.

9. Process of claim 8, wherein the fibers of the fiber-containing binding agent are cellulose-containing staple fibers containing up to 100 weight parts of dust thereof and up to 100 weight parts of cellulose for 10 to 50 weight parts of the fibers and 2 to 30 weight parts of synthetic staple fibers.

10. Process of claim 1, wherein the polymer comprises a polymer or copolymer on the basis of latex, acrylate, methacrylate, polyurethane, butadiene-acrylonitrile, butadienestyrene, a copolymeric precondensate of any of the former, or formaldehyde resin with phenol, melamine or urea resin.

11. Process of claim 1, and further comprising foaming the binding agent with air to a liter weight of 200–500 g for filling the material of loose fibers therewith.

12. Process of claim 1, wherein the material of loose fibers is a nonwoven material which is prebonded loosely with a binding agent or binding fibers.

13. Process of claim 1, wherein the material of loose fibers is a loose preneedled fleece material.

14. Process of claim 13, wherein the fleece material is preneedled in parallel longitudinal rows.

15. Process of claim 1, wherein the material of loose fibers contains cellulosic fibers.

16. Process of claim 1, wherein the material of loose fibers is a fleece material which contains powdered and/or finely granular abrasives as filler.

17. Process of claim 1, wherein the material of loose fibers is a fleece material, and further comprising obtaining the fleece material by deposition from an aqueous, latex-containing fiber suspension onto a porous conveyor belt.

* * * * *